US006561181B2

(12) United States Patent
Tseng et al.

(10) Patent No.: US 6,561,181 B2
(45) Date of Patent: May 13, 2003

(54) JET AIRSTREAM GUIDANCE DEVICE

(76) Inventors: Suh-Ha Tseng, No. 6-20, San Tseng, 18 Lin, Fu-An Li, Da-Shi Jen, Tayouan Hsien (TW); Yen-Yu Lee, No. 6-20, San-Tseng, 18 Lin, Fu-An Li, Da-Shi Jen, Tayouan Hsien (TW)

( * ) Notice: Subject to any disclaimer, the term of this patent is extended or adjusted under 35 U.S.C. 154(b) by 0 days.

(21) Appl. No.: 09/779,940

(22) Filed: Feb. 9, 2001

(65) Prior Publication Data

US 2002/0108608 A1 Aug. 15, 2002

(51) Int. Cl.[7] ..... F24C 15/20
(52) U.S. Cl. ..... 126/299 R; 126/299 D
(58) Field of Search ..... 126/299 R, 299 D; 454/63, 67

(56) References Cited

U.S. PATENT DOCUMENTS 2,855,837 A * 10/1958 Bakke ..... 126/299 D
4,098,616 A * 7/1978 Dorius et al. ..... 454/67

FOREIGN PATENT DOCUMENTS

DE 10008014 A1 * 8/2001
JP 61-295450 A * 12/1986 ..... 126/299 D

* cited by examiner

*Primary Examiner*—Sara Clarke
(74) *Attorney, Agent, or Firm*—Raymond Y. Chan; David and Raymond Patent Group

(57) ABSTRACT

An airstream guidance can gather up exhaust by the gaseous guidance to change the flowing direction of air stream in a more effective way. It can exert the jet airstream immediately gathering the air and soot to exhaust outdoors via the suspension fan or via other air-extracting fittings as to improve the defects such as an escape of exhaust or the scattered soot. Besides, the present invention can be assembled or disassembled easily so as to clean. As to the production, it can lower the costs and increase the market competition.

5 Claims, 5 Drawing Sheets

JET AIRSTREAM GUIDANCE DEVICE

BACKGROUND OF THE PRESENT INVENTION

1. Field of Invention

The present invention relates to an airstream guidance, which is a device of another form of jet airstream guidance that can gather up exhaust by the current guidance to change the effective flowing direction of air stream.

2. Description of Related Arts

According to a survey of women health, general housewives, who often cook breathe in considerable exhaust from a smoke exhaust machine. The imperceptible exhaust is accumulated inside the body day after day that may cause illness and do harm to the skin.

Furthermore, the electronic power consumption of the smoke exhaust machine is tremendous. Base on the investigate report, an exhaust fan consumes the electric power as much as 80 watt. The conventional smoke exhaust machine, which is ordinary provided with two exhaust fans, consumes electric power as much as 160 watt, not including the lighting apparatus. In other words, the conventional smoke exhaust machine is not a good design and concerns various shortages that should be improved.

Regarding to the conflict among the oil-producing countries in the Middle East, the uncertain support of domestic electric power and the energy crisis explosion, we should more cherish and economize the use of energy source.

Therefore, there are many defects in the prior arts which are necessary to improved.

SUMMARY OF THE PRESENT INVENTION

Accordingly, the primary object of the present invention is to provide a jet airstream guidance device which can exert the jet airstream to gather immediately the air and soot to exhaust outdoors via the suspension fan or via other air-extracting fittings.

Another object of the present invention is to provide a jet airstream guidance device which helps to reduce the lung disease, the infected respiratory tract, and the pock caused by the long-term exhaust contact.

Another object of the present invention is to provide a jet airstream guidance device which can be assembled easily and lower the production costs, that is valuable for producers and consumers.

Another object of the present invention is to provide a jet airstream guidance device which can reduce the rolling noise of the suspension fan.

In order to achieve the aforesaid objects, the present invention provides a jet airstream guidance device comprising a body prop in which its upside connects with a plurality of air pipes on two sides to exhaust; the upside and the two sides containing a plurality of tenons; the opposite airstream baffles, as a simple assembled structure, having grooves corresponding to engage to each tenons of the upside and the two sides in the body prop so as to disassemble; a suspension guidance appliance hanged beneath a top of body prop in a proper distance extracting the rising exhaust along the airstream baffles; front auxiliary bellows on the two downsides of airstream baffle set air-extracting fans and an upside of the auxiliary bellows provide the plurality of air pipes. By assembling the components mentioned above, the exhaust can be gathered via the two sides of the auxiliary bellows along the airstream baffles to the upper part and by the suspension guidance appliance, discharging the exhaust efficiently improves the defeats such as an escape of exhaust or the scattered soot.

The drawings disclose an illustrative embodiment of the present invention which serves to exemplify the various advantages and objects hereof.

DETAILED DESCRIPTION OF THE PREFERRED EMBODIMENT

Figure 1:
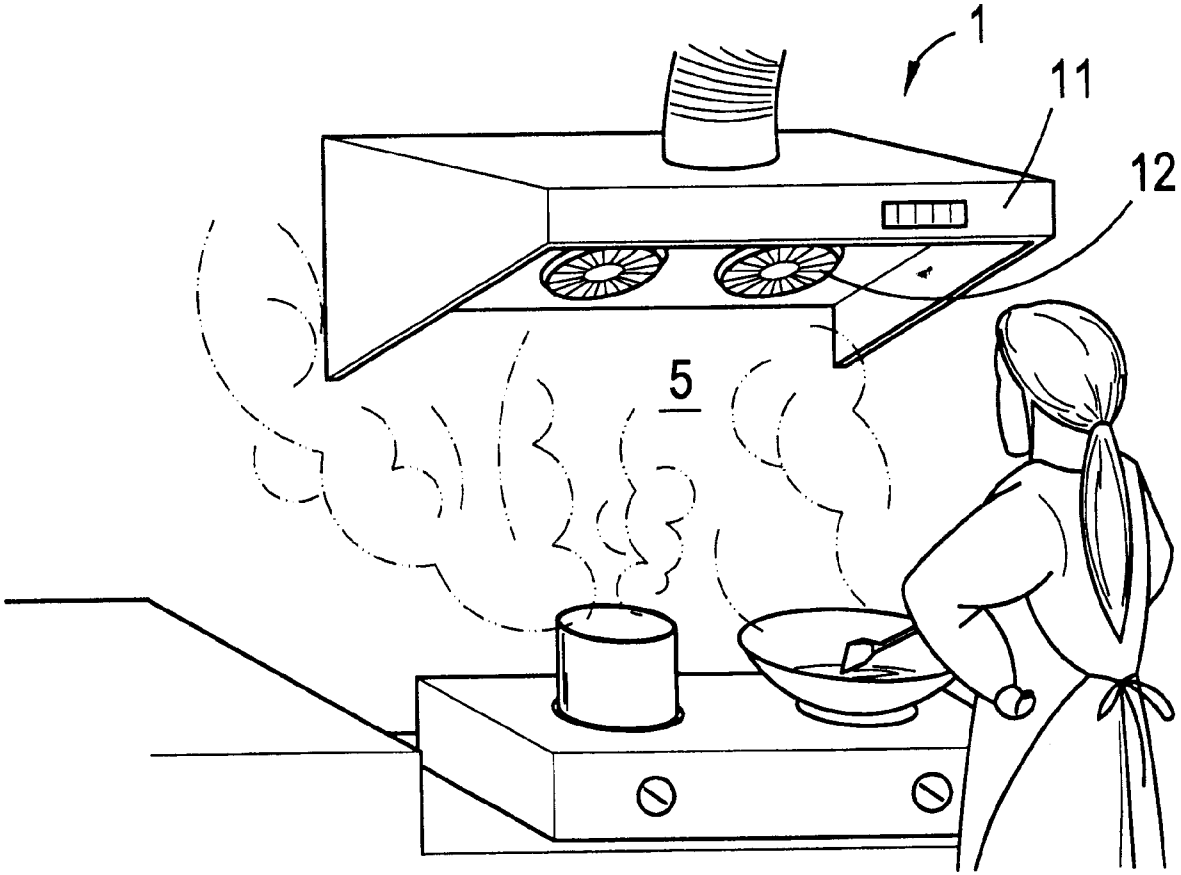
PRIOR ART FIG. 1
FIG. 1 illustrates a schematic view of a prior art smoke exhaust machine.

FIG. 1 shows a conventional smoke exhaust machine 1, which comprises bellows 11 and at least an air-extracting leaf 12 to exhaust the soot 5 outdoors. However, the traditional smoke exhaust machine cannot exhaust outdoors completely and brings about the bad smell of oil sludge indoors or in the kitchen. Furthermore, the structure of the bellows and the air-extracting leaf is not so simple to make and consumes materials. Therefore, the production cost is too high for market competition, so that neither the producers not the consumers are able to afford it.

Figure 2:
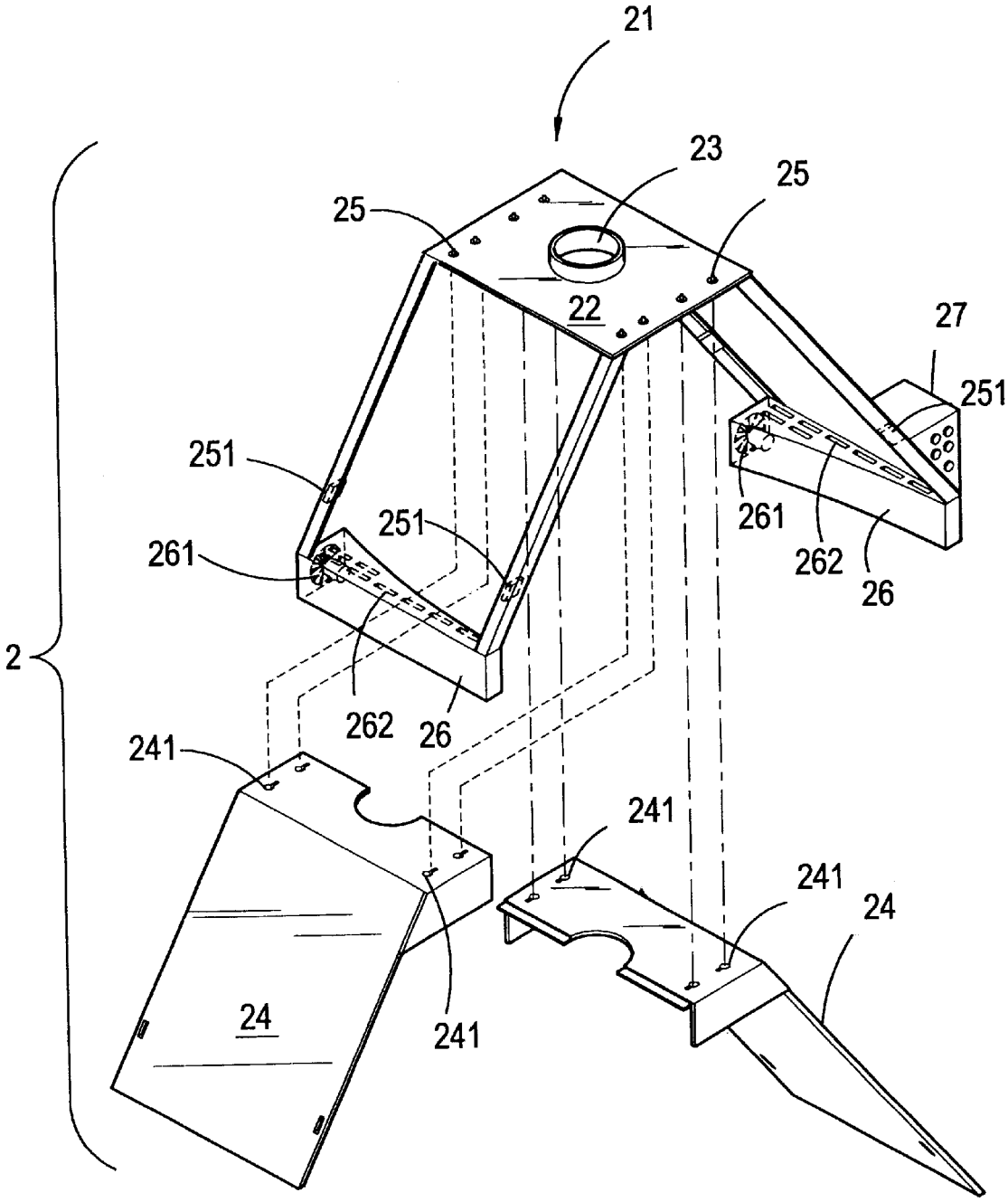
FIG. 2 is an exploded perspective view of a jet airstream guidance device according to the present invention.

Referring to FIG. 2, a jet airstream guidance device 2 of the present invention is illustrated, which comprises a body prop 21 to support the whole structure of the device. An upside 22 of the body prop 21 has an outlet 23 for connecting with an exhaust pipe to discharge the soot and exhaust outside. A downside of the outlet 23 provides a suspension guidance appliance 3 (FIG. 3) hanged beneath the upside 22 of the body prop 21 in a proper distance to extract the rising exhaust along airstream baffles 24 out through the outlet 23. The upside and two sides of body prop 21 contain a plurality of tenons 25, 251 to buckle grooves 241 of airstream baffles 24 so as to easy assemble together. Concerning this characteristic, the panel board can be made in different length or width to fit with varied circumstances. The airstream baffles 24 even can add an airstream baffle behind the body prop 21 to form an airtight space to guide the airstream. Simultaneously, referring to FIG. 4, a downside of body prop 21 provides auxiliary bellows 26, each of which back ends has an air inlet fan 261 to inhale the outer air into the bellows and the plurality of air pipes 262 to form an air-rotating device. The shape of each of the auxiliary bellows 26 is extended gradually from front to back so as to highly concentrate the exhaust and do not impede cooking. It also takes human engineering into consideration. On one side of the auxiliary bellows, there is a control panel 27 comprising operation functions, power status indication and auxiliary lighting equipment. A safety fuse is provided in the power input control to prevent from the damage of electric appliance.

Figure 3:
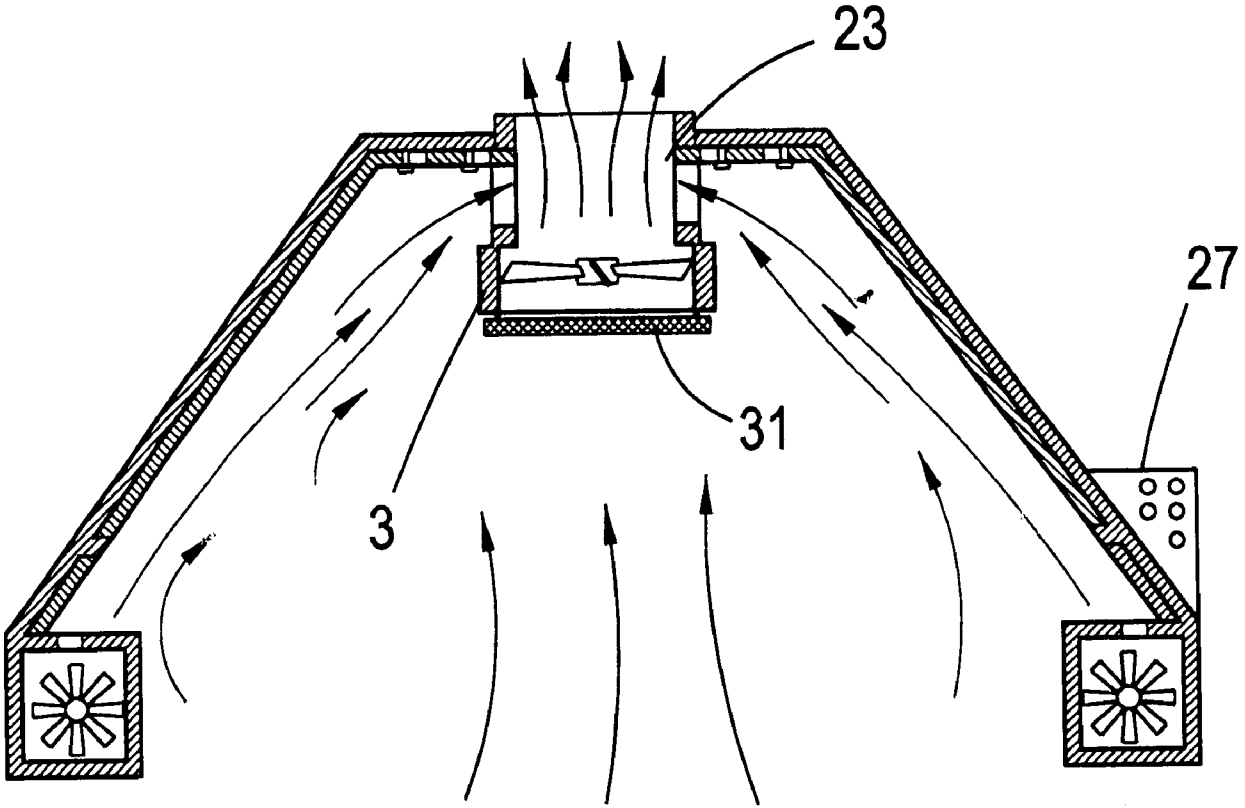
FIG. 3 is a schematic view of the suspension guidance appliance of the jet airstream guidance device according to the present invention.

Referring to FIG. 3, showing a partial structure of the suspension guidance appliance 3 to reinforce the exhaust device. The suspension guidance appliance 3 is at a proper range from the outlet 23 which exhausts the gathered soot outdoors by a rotating fan forming the jet airstream. The underside of the suspension guidance appliance 3 includes a filter net 31 to protect the user from harm by touching the suspension guidance appliance 3 accidentally. In addition, each leaf of the rotating fan of the suspension guidance appliance 3 consumes the electric power around 17 watt so 3 leaves consumes 51 watt, not including other power consumption such as light or intensive wind velocity function. Comparing with power consumption of the traditional smoke exhaust machine, it is much lower and saves the energy resources. In order to enhance the exhausting speed and quantity, the suspension guidance appliance 3 can be in accordance with the demand to add up to two or three suspension guidance appliances alongside.

Figure 4:
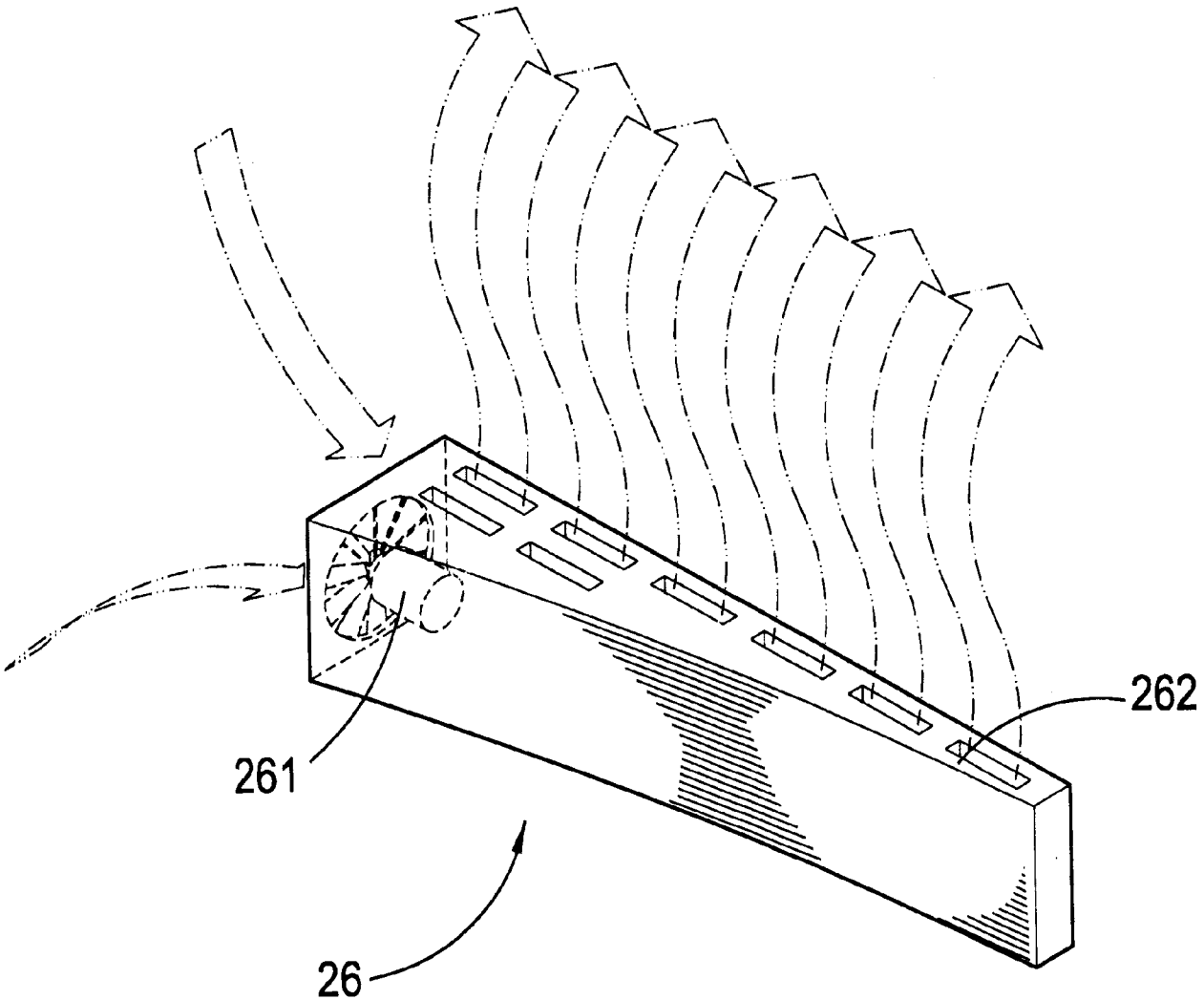
FIG. 4 is a schematic view illustrating the auxiliary bellows of the jet airstream guidance device according to the present invention.

Referring to FIG. 4, it is the preferred embodiment drawing of the auxiliary bellows. The streamline mold of the auxiliary bellows 26 extends gradually from front to back so as to highly concentrate the exhaust. The rearward of each of the auxiliary bellows 26 has the air inlet fan 261 to inhale the outer air into the bellows 26. Each of the auxiliary bellows 26 has the plurality of air pipes 262 forming an air-rotating device. From the raising air current produced by air pipes 262, the soot is pushed forward to the upper part, suspension guidance appliance 3, to discharge or inhale.

Figure 5:
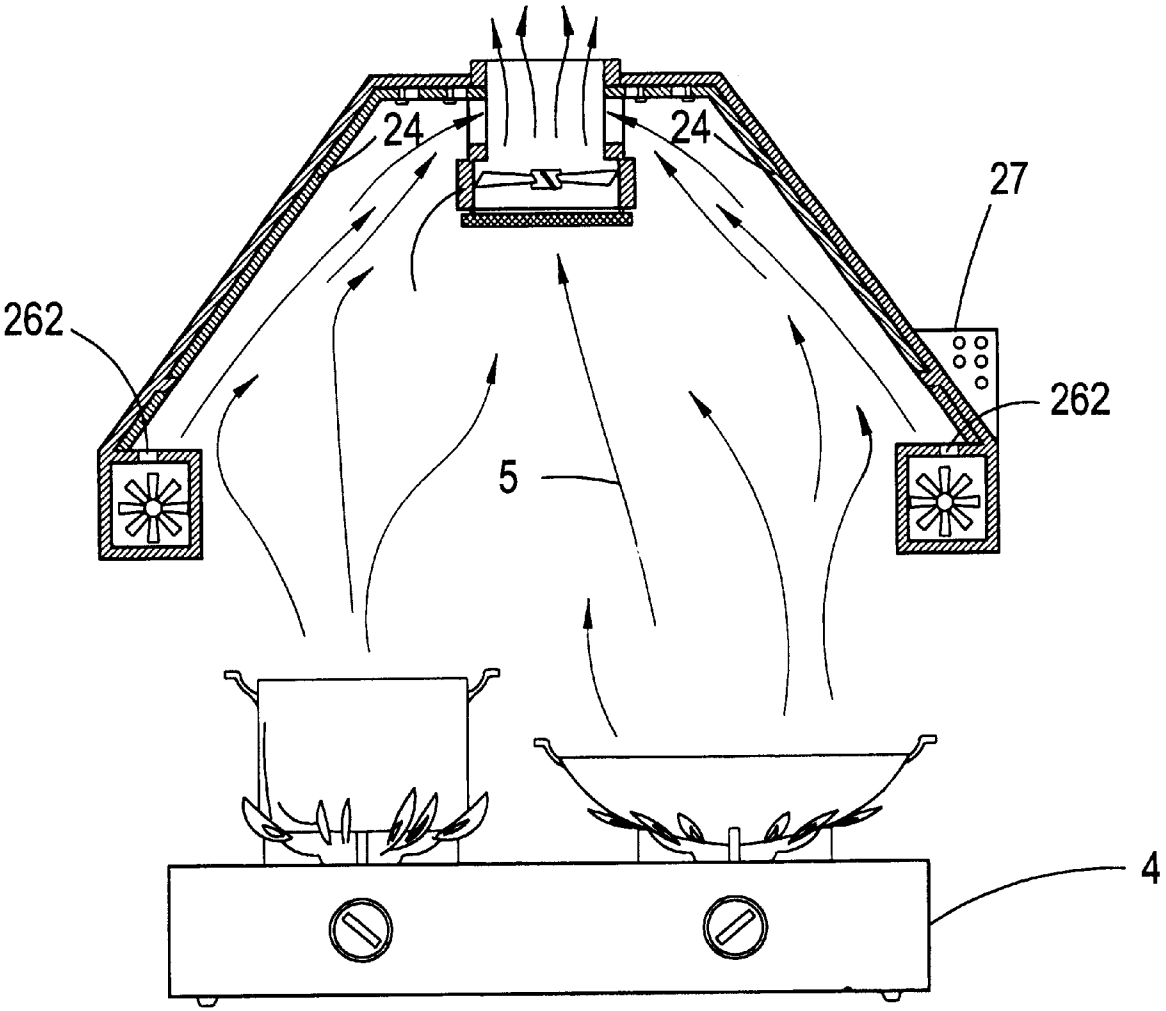
FIG. 5 is schematic view illustrating the airstream state while the jet airstream guidance device is in use according to the present invention.

Referring to FIG. 5, it illustrates the soot 5 produced by general gas-cooker 4. The soot 5, which is pushed upward according to the heat convection principle, would not let out but in the protection cover formed by the airstream baffle 24. Furthermore, the soot 5 would be pushed upward by means of the ascended air current formed by the air pipes 262 of the auxiliary bellows 26 while approaching the airstream baffle 24. Then, the downward suspension guidance appliance 3 hanged below the outlet 23 exhausts the soot out and exhaust the those directly pushed upward without passing through the air pipes 262.

The present invention can adjust the stature by utilizing the stature appliance. That is the motive power component that sets the wheel on a back of the body prop and track on the wall. By means of electric control method regulating the jet airstream guidance device in accordance with the cookers' dimension arranges the space. Or by means of mechanism, it takes the bearing as support to combine the ring screw fixed on the present jet airstream guidance device upward and downward.

Comparing the present invention with the conventional smoke exhaust device, it provides more merits as follows:

1. Compulsory jet airstream discharges the exhaust outdoors to decrease the liquid substance formed by the quenched reaction of soot cohering on the smoke exhaust device in order to prevent the kitchen contamination from dropping the oil sludge in the cooking utensils to maintain the food hygiene.

2. Besides the soot harm the skin, the noise from the smoke exhaust machine, pans, slices and etc. would aggravate the affliction. The present invention can improve the noisy problem of smoke exhaust machine.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A jet airstream guidance device, comprising:

a body prop having an upside provided with an outlet, a downside and two sides each providing in a plurality of tenons;

two airstream baffles formed at said two sides of said body prop, wherein each of said airstream baffles has grooves engaged with said tenons for easy assembly;

a suspension guidance appliance hanged beneath a top of said body prop, wherein said suspension guidance appliance has a distance from said outlet for extracting rising exhaust along said airstream baffles;

an air-rotating device comprising two auxiliary bellows provided at said downside of said body prop, wherein each of said auxiliary bellows comprises an air inlet fan at a rear end thereof to inhale outer air into said two auxiliary bellows and has a plurality of air pipes thereon to produce raising air current for pushing exhaust forward to said suspension guidance appliance, so that said exhaust is gathered via said auxiliary bellows along said airstream baffles to an upper part and discharged by said suspension guidance appliance through said outlet; and a control panel provided at a side of one of said auxiliary bellows.

2. A jet airstream guidance device, as recited in claim 1, further comprising one or more suspension guidance appliances provided alongside.

3. A jet airstream guidance device, as recited in claim 1, wherein said outlet provided on said upside of said body prop is communicated with said suspension guidance appliance.

4. A jet airstream guidance device, as recited in claim 1, wherein each of said auxiliary bellows has a shape extended gradually from front to back for concentrating said exhaust.

5. A jet airstream guidance device, as recited in claim 1, further comprises a filter net provided at an underside of said suspension guidance appliance.

* * * * *